US006861140B2

(12) United States Patent
Peleman

(10) Patent No.: US 6,861,140 B2
(45) Date of Patent: Mar. 1, 2005

(54) BINDING ELEMENT

(75) Inventor: Guido Frans Maria Jozef Peleman, Puurs (BE)

(73) Assignee: Unibind (Cyprus) Limited, Nicosia (CY)

( * ) Notice: Subject to any disclaimer, the term of this patent is extended or adjusted under 35 U.S.C. 154(b) by 0 days.

(21) Appl. No.: 10/297,922

(22) PCT Filed: Jun. 27, 2001

(86) PCT No.: PCT/BE01/00110

§ 371 (c)(1),
(2), (4) Date: Apr. 18, 2003

(87) PCT Pub. No.: WO02/00444

PCT Pub. Date: Jan. 3, 2002

(65) Prior Publication Data

US 2003/0157306 A1 Aug. 21, 2003

(30) Foreign Application Priority Data

Jun. 28, 2000 (BE) ..... 2000/0416

(51) Int. Cl.[7] ..... B42D 3/00; B42D 1/06

(52) U.S. Cl. ..... 428/354; 412/8; 412/900; 281/21.1; 428/344; 428/343; 428/347

(58) Field of Search ..... 412/8, 900; 281/21.1; 428/344, 343, 347, 354

(56) References Cited

U.S. PATENT DOCUMENTS 4,289,330 A * 9/1981 Wiermanski ..... 281/21 R
5,120,176 A * 6/1992 Bhatia et al. ..... 412/8
5,156,510 A * 10/1992 Uehara ..... 412/8
5,733,087 A * 3/1998 Gwyn ..... 412/8

FOREIGN PATENT DOCUMENTS

FR 2 276 944 * 3/1976
GB 2218043 A * 11/1989

OTHER PUBLICATIONS

PCT Intl Prelim Exam Report, 4/02.*
Intl Search Report, 11/01.*
Jap Pat Abstract 08337076, 12/96.*
BE 830705 A Abstract —[from family of FR'944], 12/75.*

* cited by examiner

*Primary Examiner*—Daniel Zirker
(74) *Attorney, Agent, or Firm*—Bacon & Thomas, PLLC

(57) ABSTRACT

A binding element including a metal sheet and an intermediate layer secured to the metal sheet. A first glue adheres a first surface of the intermediate layer to the metal sheet, and has a predetermined melting temperature. A second glue is provided on a second surface of the intermediate layer opposite the first surface, and has predetermined melting temperature. The melting temperature of the first glue is higher than the melting temperature of the second glue.

4 Claims, 1 Drawing Sheet

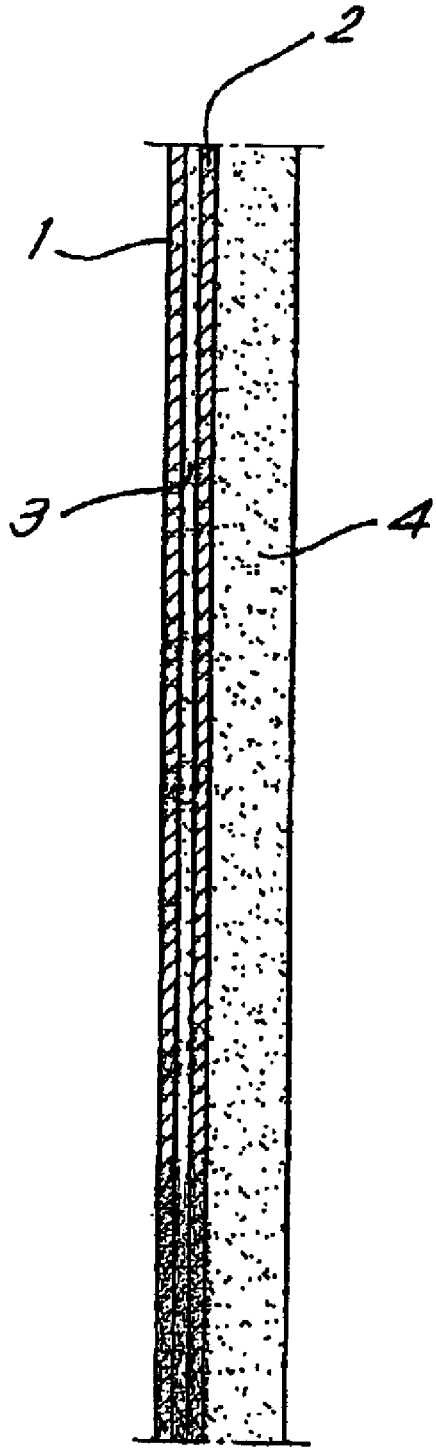
2
1
3
4

BINDING ELEMENT

BACKGROUND

The present invention relates to an improved binding element, more particularly a binding element of the type whereby the interior of the back is provided with an amount of glue which melts under the influence of heat and whereby the intention is to apply the edges of a number of sheets or documents in this melted glue, in such a manner that, after the glue has hardened, said sheets or documents are fastened in a solid manner.

More particularly, the present invention relates to such binding element, the back of which is formed by a metal strip which either or not is folded into a certain shape and whereby said amount of glue is provided on this metal strip.

It is known that for an ideal binding of sheets, documents or the like, it must be provided for that the so-called binding glue becomes as liquid as water, such that the documents can settle into the binding glue due to their own weight, without the necessity of tapping on the documents in order to insert them into the binding glue.

In this manner, the heating of said binding glue can be stopped at a certain moment, without any other intermediary, after which cooling can take place.

Only on the basis of said conditions, one may speak of a really automatic binding.

SUMMARY

In a particular embodiment, said back will be realized in a U-shape, whereby the meltable binding glue is provided in the base of said back.

However, an important disadvantage thereof is that the meltable binding glue does not adhere well to the hard metal back.

Thus, the present invention relates to improvements by which a perfect connection between said meltable glue or binding glue and said metal back is obtained in a simple manner.

It is known that binding glues which are provided in such aforementioned binding element or binding file are designed such and show such features that they specifically can glue paper, cardboard or such in a very good manner.

The disadvantage thereof is that these binding glues, however, do not adhere well to metal.

At the same time, it is known that the temperature of said binding glues may not exceed 130° C., as otherwise possible synthetic materials, such as PVC, PP or such, which form part of the binding element or the binding file, might be thermically damaged.

The present problem, thus, is that the binding glue, which really is very liquid below 130° C., and which glues paper, cardboard and the like in a very good manner, badly adheres to hard metal elements, such as the back of a binding element or binding file.

It is also known that said binding glues, when they glue paper, cardboard and the like in a very good manner and also adhere to metals, such as, for example, steel, in a very good manner, even above 130° C. become so little liquid that the sheets, documents or the like will not settle into the binding glue by themselves, but will have to be beaten in by tapping on these sheets, documents or the like.

To this aim, for example, first an intermediate layer is applied to the metal, by means of a glue which only melts above 130° C. and which forms a good connection between metal and paper, after which a second glue, which melts below 130° C., is applied on the opposing outer surface of the intermediate layer.

The intermediate layer may be formed of paper.

The improvements allowing the aforementioned and other advantages, substantially consist of a part consisting of metal; on this part, an intermediate layer which is adhered to this part by means of a high-temperature glue; and on said intermediate layer, a low-temperature glue.

BRIEF DESCRIPTION OF THE DRAWING

With the intention of better showing the characteristics of the invention, hereafter, as an example without any limitative character, a preferred form of embodiment of the improvements according to the invention is described, with reference to the accompanying drawing, which schematically represents the connection of sheets, documents or the like with the metal back of a binding element, binding file or the like.

DESCRIPTION OF VARIOUS EMBODIMENTS

In the drawing FIGURE, an embodiment of an improved binding element is shown as having a metal sheet 1 and an intermediate layer 2 secured to the metal sheet 1. A first glue 3 adheres a first surface of the intermediate layer 2 to the metal sheet 3, and has a predetermined melting temperature. A second glue 4 is provided on a second surface of the intermediate layer 2 opposite the first surface, and has a predetermined melting temperature. The melting temperature of the first glue 3 is higher than the melting temperature of the second glue 4.

While any suitable material may be used as the intermediate layer 2, it is preferred that this material is paper in accordance with the embodiment described above.

The present invention is in no way limited to the embodiment described as an example and represented in the drawings; on the contrary, it may be realized in a variety of forms, dimensions and compositions without leaving the scope of the invention.

What is claimed is:

1. A binding element comprising:

a metal sheet;

an intermediate layer having opposed first and second surfaces, the first surface adhering to the metal sheet;

a first glue having a predetermined melting temperature and securing the metal to the first surface of the intermediate layer; and a second glue having a predetermined melting temperature and disposed along the second surface of the intermediate layer;

wherein the melting temperature of the first glue is higher than the melting temperature of the second glue.

2. The binding element according to claim 1, wherein the intermediate layer is formed by a sheet of paper.

3. The binding element according to claim 1, wherein the melting temperature of the first glue is above 130° C.

4. The binding element according to claim 1, wherein the melting temperature of the second glue is below 130° C.

* * * * *